US006990909B2

(12) United States Patent
Gosling et al.

(10) Patent No.: US 6,990,909 B2
(45) Date of Patent: Jan. 31, 2006

(54) CONSOLE WITH POSITIONALLY INDEPENDENT UPPER AND LOWER HALVES

(75) Inventors: Geoff Gosling, Calgary (CA); Blehm Colin, Calgary (CA)

(73) Assignee: Evans Consoles Corporation, Calgary (CA)

( * ) Notice: Subject to any disclaimer, the term of this patent is extended or adjusted under 35 U.S.C. 154(b) by 0 days.

(21) Appl. No.: 10/272,743

(22) Filed: Oct. 17, 2002

(65) Prior Publication Data

US 2003/0071546 A1 Apr. 17, 2003

(30) Foreign Application Priority Data

Oct. 17, 2001 (CA) ..... 2359165

(51) Int. Cl.
*A47B 41/02* (2006.01)

(52) U.S. Cl. ..... 108/50.02; 312/196

(58) Field of Classification Search ..... 312/223.3, 312/257.1, 265.4, 223.6, 265.1, 194, 195, 312/196, 107, 108, 111; 108/50.02, 92, 102, 108/50.01; 52/36.1, 36.5, 36.4, 239
See application file for complete search history.

(56) References Cited

U.S. PATENT DOCUMENTS

| | | | | |
|---|---|---|---|---|
| 978,299 | A * | 12/1910 | Jacobs | 351/245 |
| 1,417,401 | A * | 5/1922 | Mahoney | 312/297 |
| 4,586,759 | A * | 5/1986 | Wrobel | 312/198 |
| 4,619,486 | A * | 10/1986 | Hannah et al. | 312/195 |
| 4,836,625 | A * | 6/1989 | Catta | 312/265.1 |
| 5,628,257 | A | 5/1997 | Conner et al. | |
| 5,833,332 | A | 11/1998 | Marshall et al. | |
| 5,975,657 | A * | 11/1999 | LaCour | 312/196 |
| 6,076,903 | A * | 6/2000 | Vander Park | 312/196 |
| 6,267,338 | B1 * | 7/2001 | Saylor et al. | 248/200 |
| 6,302,035 | B1 * | 10/2001 | Frenkler et al. | 108/102 |
| 6,382,747 | B1 * | 5/2002 | Catta et al. | 312/257.1 |
| 6,712,433 | B2 * | 3/2004 | Hellwig et al. | 312/223.6 |
| 6,725,784 | B2 * | 4/2004 | Crinion | 108/64 |

FOREIGN PATENT DOCUMENTS

| | | |
|---|---|---|
| DE | 298 00 263 U | 2/1998 |
| EP | 0 791 311 A1 | 8/1997 |
| FR | 1050738 A | 1/1954 |
| WO | WO 97/13431 | 4/1997 |

* cited by examiner

*Primary Examiner*—Janet M. Wilkens
(74) *Attorney, Agent, or Firm*—Notaro & Michalos P.C.

(57) ABSTRACT

A console structure for supporting equipment thereon, comprising a lower base structure; an upper turret structure supported on the base structure; the turret structure being independently laterally positionable relative to the base structure.

14 Claims, 13 Drawing Sheets

CONSOLE WITH POSITIONALLY INDEPENDENT UPPER AND LOWER HALVES

FIELD OF THE INVENTION

The present invention relates to a framework for supporting pieces of work station equipment, and more particularly to a console structure for supporting electronic equipment in the nature of computers, video monitors, control panels and the like.

BACKGROUND OF THE INVENTION

Control consoles of the type described herein generally include a framework for receiving and supporting the necessary pieces of electronic and support equipment including terminals, monitors, keyboards, switch panels, telephone turrets, lighting and so forth, and a planar work surface extending outwardly from the framework at a convenient height. Some of the equipment including video monitors and output displays is supported to be visible above the work surface for convenient viewing and user access. Attractive finishing panels are also usually supported by the basic framework.

To date, many work station consoles have been custom manufactured which in terms of design and construction is both expensive and time consuming. This approach has been necessitated by customer requirements that are often unique in terms of work station size, equipment placement, human engineering and cost considerations. In the result, the completed console structures are not only extremely expensive, but are also difficult if not impossible to subsequently modify for the reconfiguration of existing equipment or to retrofit new equipment. An alternative approach has been to assemble the consoles from fixed size modular sections. This approach can reduce costs, and although there may be some loss of flexibility with respect to subsequent modifications and reconfigurations of equipment within the console, there are simply many instances in which the cost savings outweigh the advantages of a system critically engineered to permit unlimited post-installation reconfiguration. Some flexibility must however remain.

A need therefore exists for a console structure which overcomes the problems inherent in either the custom design and manufacture or completely modular assembly of console structures. One such approach has been developed by the Applicant and is described in Canadian Patent 1,291,518 issued Oct. 29, 1991 (equivalent to U.S. Pat. No. 4,836,625).

The backbone of the console structure shown in the aforementioned patents are the horizontally spaced, vertically upright gable members 1. The gables are interconnected by stringers 2 to provide a rigid framework for the console structure. The spacing between gables is infinitely variable so that the framework as a whole is easily adapted to custom requirements both before and after initial on-site assembly. Because most of the equipment in the console is supported by or suspended from the interconnecting stringers, changing the distance between gables is not in and of itself all that disruptive of the system as a whole and particularly the equipment mounting hardware, and this lends the overall structure enormous flexibility. This flexibility comes however at a cost. The gables are metal fabricated usually from tubular steel and are therefore relatively expensive to manufacture and store. The stringers are typically aluminum extrusions and are therefore relatively inexpensive linear stock easily stored, but significant numbers of different stringers of different shapes and configurations depending upon function are required and an idea of the number and types of stringers needed can be seen from FIGS. 3 to 9 of the patent. This therefore also adds to cost and the need for significant inventory control. The need for this number of stringers is made necessary in part because the gables, as aforesaid, are almost entirely structural in function and integrate no channels, interlocks or other mechanical means that increase their versatility or allow them to perform multiple tasks.

The Applicant has found that although there will continue to be a strong demand for the flexibility and retrofit capabilities of its customized consoles, and for modular "discreet logic" systems that cost less, many customers now demand both flexability and lower cost. To achieve these objects, it is increasingly desirable to further reduce the number of components making up the console framework but in a way that the remaining components are analogous to building blocks that can be configured, assembled together and reconfigured for maximum design flexibility and adaptability. Taking this a step further, one way to reduce product cost is to reduce the cost of sales. Particularly in respect of customized product, an intense collaboration is normally required between the customer and the manufacturer, the customer and the sales agent or all three to conceive, design and implement the final system. This is an extremely expensive process. However, by applying relatively few easily understood and manipulated standard elements, the dealer and/or client can achieve near instantaneous design capabilities. Moreover, it is contemplated that customers and/or dealers will be given on-line access to a computer implemented layout and quoting system that is expected to significantly decrease the time and cost to configure the consoles to the customer's requirements, transmit the order to the factory and deliver the system to the client for assembly.

SUMMARY OF THE INVENTION

The Applicant has therefore developed a console system which is flexible enough to meet the demands of a custom environment, but wherein the number of components in the system is significantly reduced for cost savings. Many of the remaining components "multi-task", assembly is made easier and less costly, and structural integrity is maintained.

The underlying concept of the present console system is that by dividing the console into positionally independent upper and lower halves, the level of variability and flexibility of configuration is substantially increased. This is achieved through the application of standard elements.

It is an object of the present invention therefore to provide a console structure comprising a relatively few basic components which can be easily assembled into a supporting framework for a wide variety of equipment pieces and shapes without modifications to the basic components themselves.

It is a further object of the present invention to provide a console framework providing as much unimpeded space therein as possible to maximize the adaptability of the framework for the mounting of different pieces of equipment at different locations, and the ability to meet custom requirements using the same basic components.

It is a further object of the present invention to provide a console framework upper turret half of the console that is independently positionable relative to the lower base half of the console.

According to the present invention then there is provided a console structure for supporting equipment thereon, comprising a lower base structure; an upper turret structure supported on said base structure; said turret structure being independently laterally positionable relative to said base structure.

According to the present invention then there is further provided a console structure for supporting equipment thereon, comprising a lower base structure, wherein said base structure comprises at least one base module, each base module comprising a pair of spaced apart frame ends; an upper stringer connected to and disposed between said frame ends; and a lower stringer connected to and disposed between said frame ends, the lower stringer being substantially parallel to the upper stringer and positioned beneath said upper stringer; a turret structure supported on said base structure, said turret structure comprising at least one turret module, each turret module comprising: a pair of spaced apart upper frame ends; and a beam member connected to and disposed between said upper frame ends; said turret structure being independently laterally positionable relative to said base structure.

According to the present invention then there is still further provided a method of positioning a turret structure relative to one or more base structures, said turret and base structures forming part of an equipment console used to support pieces of work station equipment, comprising the steps of forming the turret and base structures as discrete modules; and forming the turret structure to be connectable to said base structure at any point along the length of one of said base structures or straddling base structures arranged in end to end alignment with one another.

According to the present invention then there is yet further provided a method for the assembly of a framework for a console structure using discrete modules, comprising the steps of forming one or more base modules of a predetermined width, height and depth; forming one or more turret modules of a predetermined width, height and depth; assembling said base modules into a console base of predetermined width, height and depth; and mounting said one or more turret modules on said console base at a selected location or locations along the length of said console base.

BRIEF DESCRIPTION OF THE DRAWINGS

Preferred embodiments of the present invention will now be described in greater detail, and will be better understood when read in conjunction with the following drawings in which.

DETAILED DESCRIPTION

In order to accommodate various types of equipment and user requirements, the present invention is provided with a lower frame section and an upper turret section which are independently configurable relative to each other. The lower frame section can be configured to various lengths and depths to suit a user's requirements. Similarly, the upper turret section can also be configured to various lengths depending on the equipment and user requirements. Further, the length of the upper turret section is independent from the length of the lower frame section, and an upper turret section may span multiple lower frame sections, or a lower frame section may accommodate multiple upper turret sections.

The above flexibility is best illustrated with reference to the drawings.

Figure 1:
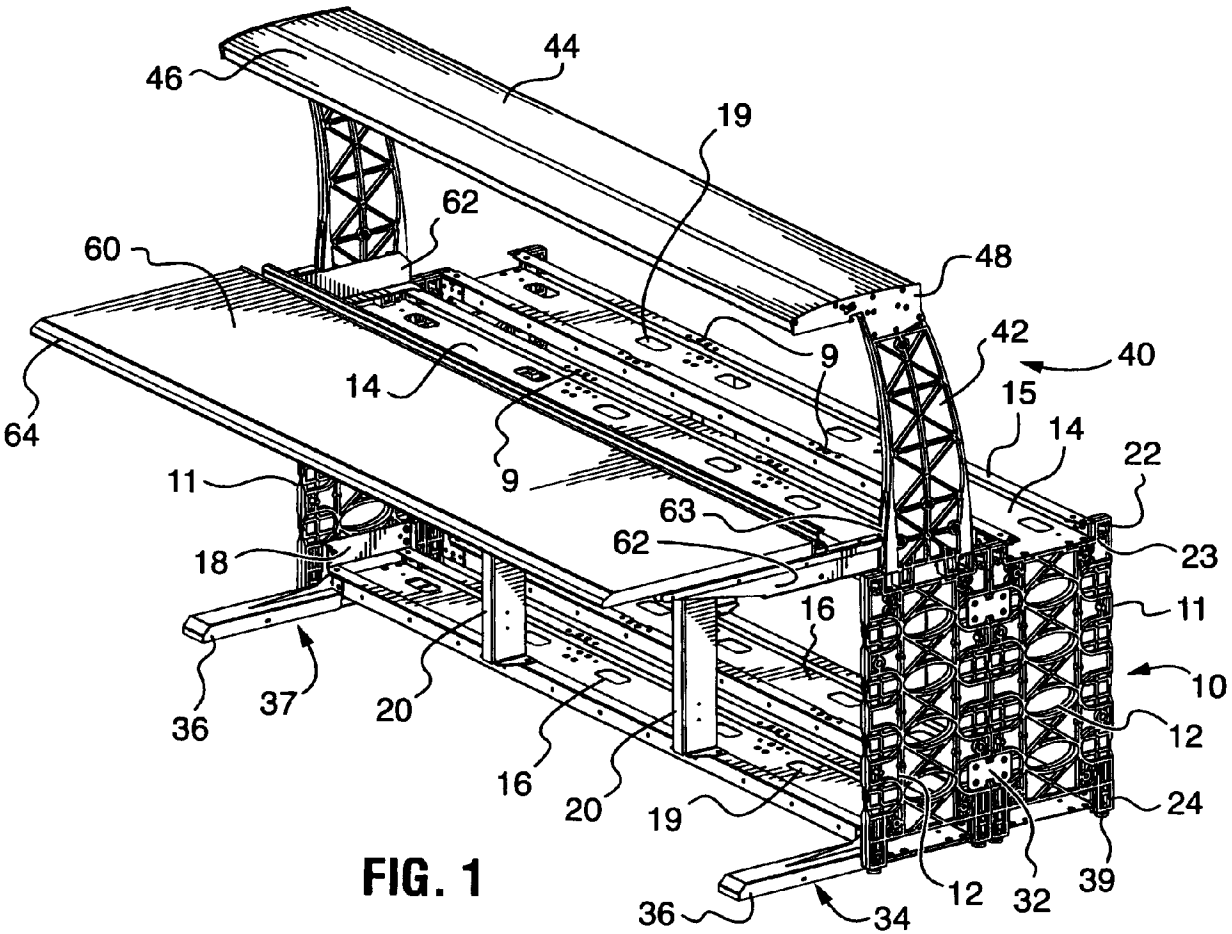
FIG. 1 is a front perspective view of the structural framework of a full depth console in accordance with the present invention.
Figure 2:
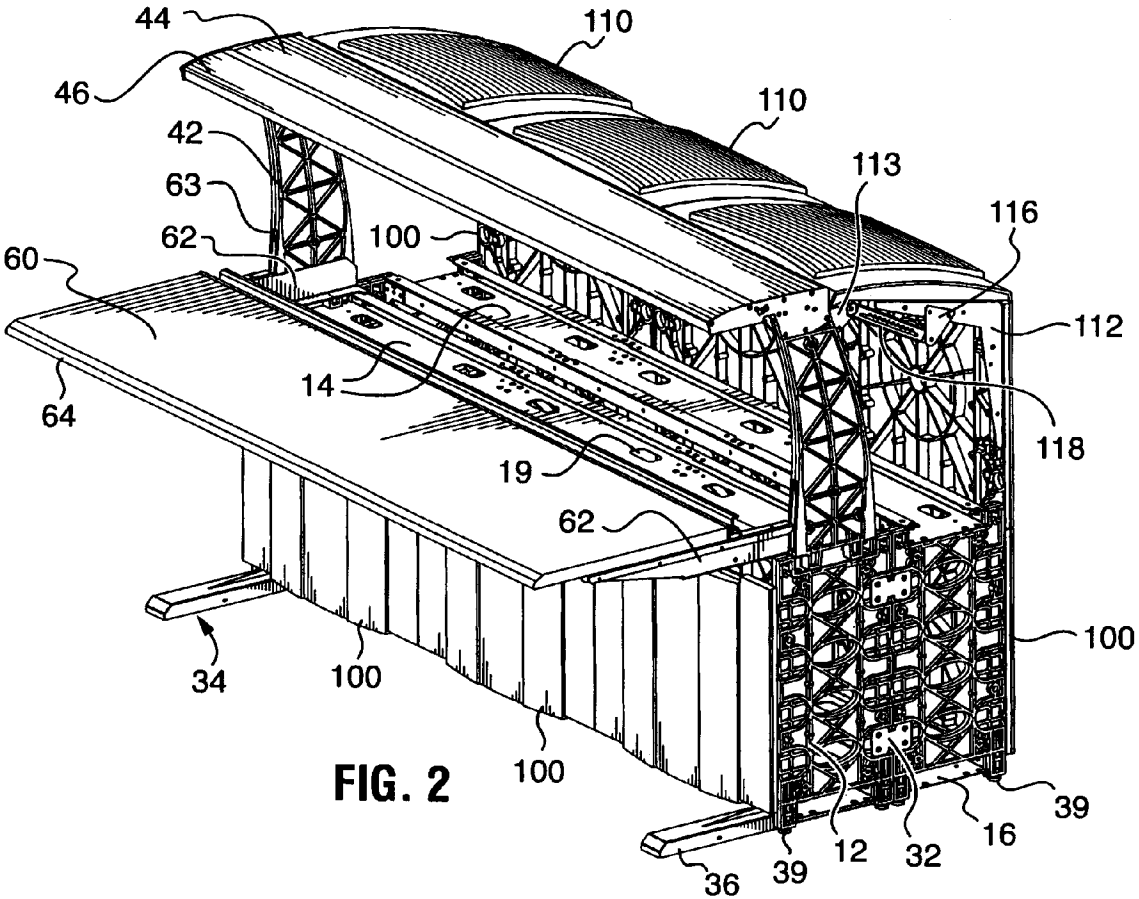
FIG. 2 is a front perspective view of the console with finishing panels applied to the front rear and upper surfaces of the framework.

FIG. 1 shows the internal components for a full depth console in accordance with the present invention. This console includes various structural subassemblies, including a base module 10, a turret 40 and a work surface 60. Each of these components is described in detail below.

One of the objects of the present invention is to provide a modular system in which the base is independent from the upper turret sections. In order to accommodate this modularity, base module 10 is assembled from a limited number of components, each sized and adapted to connect to other components within the system.

Figure 8:
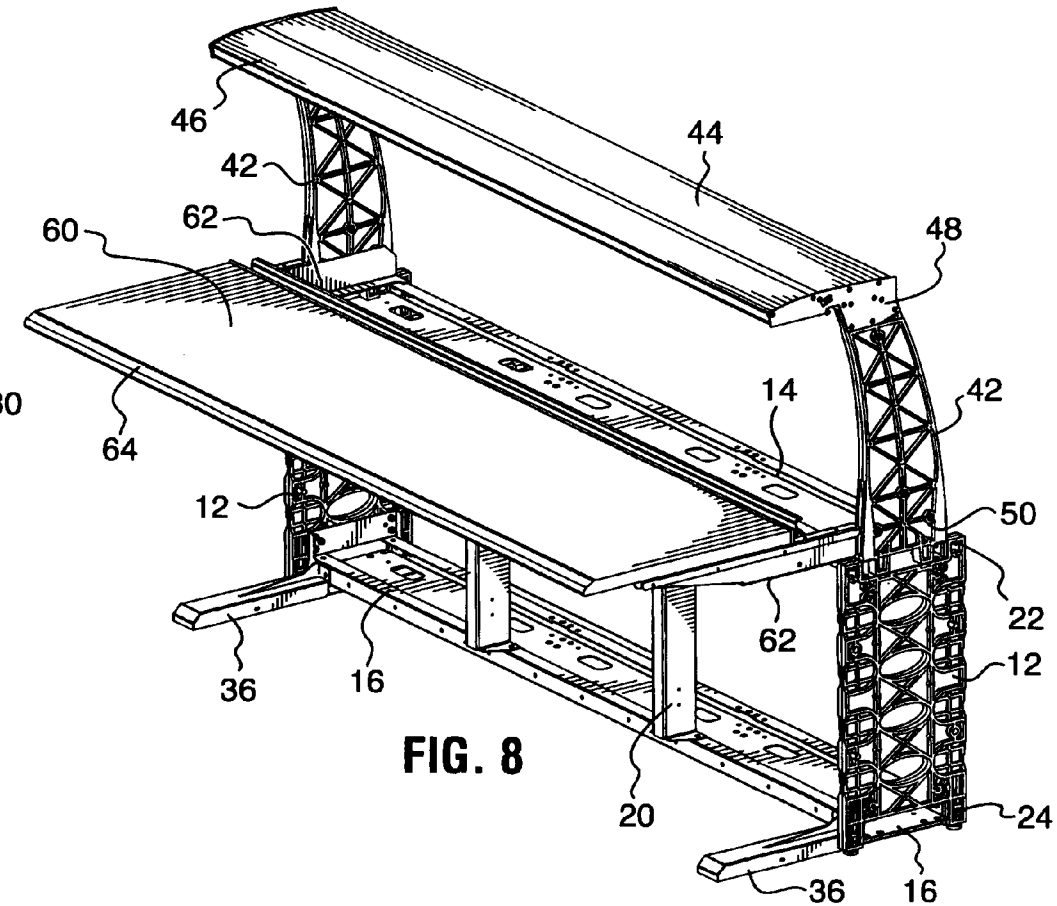
FIG. 8 is a front perspective view of a reduced depth framework for the present console.

The core components of the base module are frame ends 12 and upper and lower stringers 14/16 connected together into a typically rectangular framework 11. In the full depth console of FIGS. 1 to 6, two of these frames 11 are sistered together whereas in the reduced depth console of FIGS. 8 to 10, a single framework is used.

Figure 4:
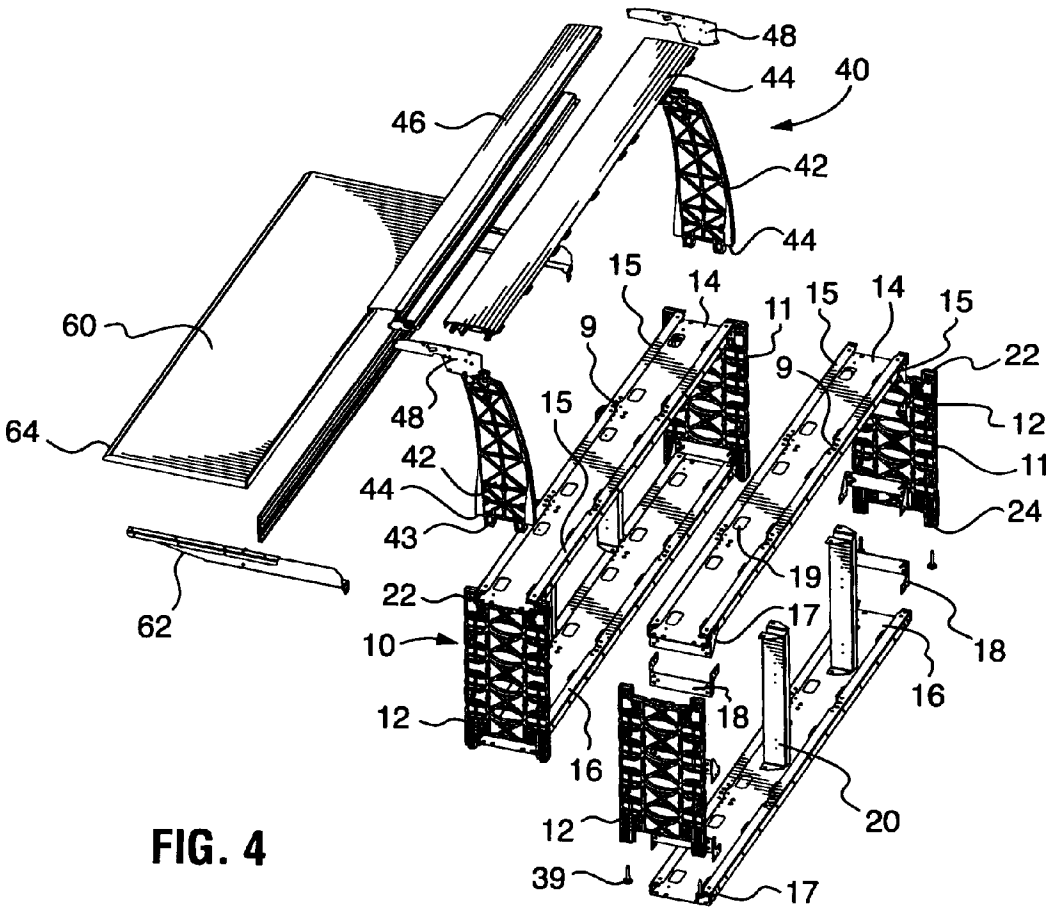
FIG. 4 is a partially exploded rear perspective view of the console.
Figure 7:
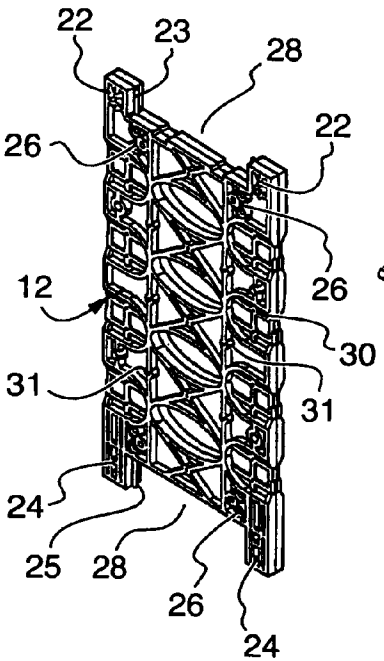
FIG. 7 is a perspective view of a lower frame end forming part of the present console.

More specifically, and with particular reference to FIG. 4, each framework 11 includes two frame ends 12 connected typically but not necessarily at opposite ends of an upper stringer 14 and a lower stringer 16. Frame end 12 is shown in isolation in FIG. 7. Each frame end 12 is preferably a partially lattice-like web defining a number of reinforcing ribs that provide structural strength while reducing weight.

Each frame end 12 is shaped to include a pair of upper protrusions 22 and a pair of slightly longer lower protrusions 24 which define between each pair a rectangular recess 28 shaped and sized to receive the ends of stringers 14/16 thereinto. A vertical flange 23 is located on each upper protrusion 22 to extend towards the centre of recess 28. Similarly, a vertical flange 25 is located on each lower protrusion 24 to also extend towards the centre of recess 28. As will be explained below, these flanges fit into correspondingly sized slits formed into the ends of the stringers to quickly and precisely connect the stringers and frame ends together.

Each frame end 12 further includes a number of preformed screw holes to accommodate the modularity of the present invention. These include gusset screw holes 26, spline plate screw holes 30, and cladding screw holes 31.

As one skilled in the art will appreciate, frame ends 12 can be manufactured from any structurally sound material, including but not limited to wood or metal. In a preferred embodiment however frame ends 12 are injection moulded from structural foam.

Base module 10 further includes an upper stringer 14 and a lower stringer 16 located between each pair of frame ends 12. Upper and lower stringers 14 and 16 respectively are preferably formed sheet metal channels that are identical to one another to save manufacturing and storage costs. Uppers and lower stringers 14 and 16 are best seen in FIGS. 1 to 4.

For the sake of modularity, upper stringers 14 and lower stringers 16 are preferably manufactured in predefined discrete lengths of 2, 4 and 6 feet (approximately 30, 60 and 90 cm).

The ends of upper stringer 14 fit into recesses 28 between upper protrusions 22 of frame ends 12 with slits in the ends of the stringer fitting together with flanges 23. The height of the rails 15 of upper stringer 14 is the same as the height of protrusions 22 for a flush fit with the top of frames 12.

Lower stringer 16 is similarly configured so that its ends fit into the recesses 28 between protrusions 24 of opposite frame ends 12 for a snap fit with vertical flanges 25.

Figure 9:
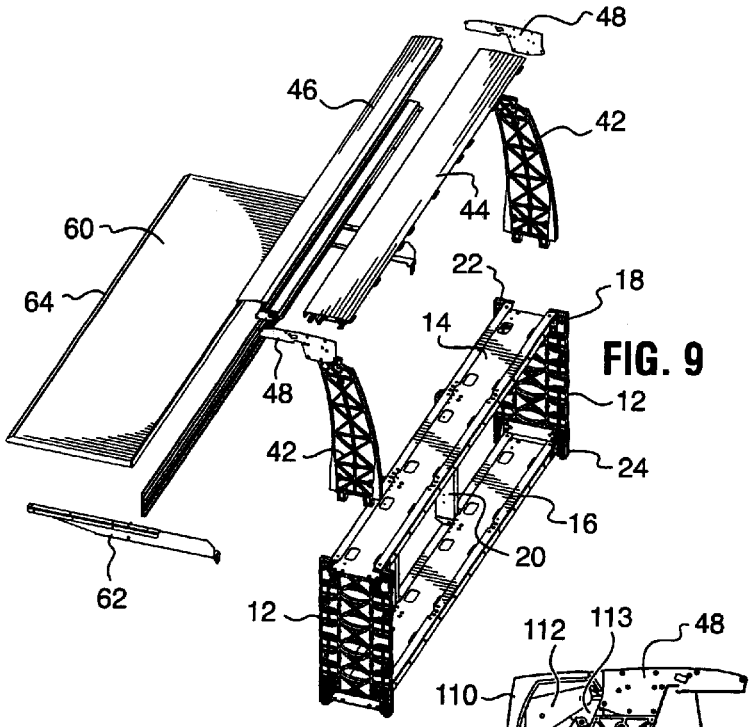
FIG. 9 is a partially exploded rear perspective view of the reduced depth console.
Figure 10:
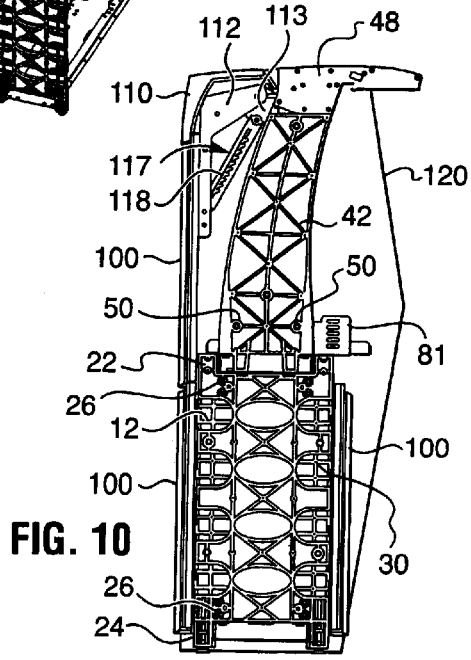
FIG. 10 is a side elevational view of the reduced depth ventilation grill.

Upper and lower stringers 14 and 16 are more securely and permanently affixed to frame ends 12 using gussets 18 seen most clearly in FIGS. 4 and 9. Each stringer 14 or 16 includes preformed screw holes 17 adjacent its ends for connection of the gussets to the sides of these stringers. Gussets 18 are then connected to frame ends 12 by screws or bolts that are threaded into gusset screw holes 26.

The stringers are also provided with a number of spaced apart apertures 19 that are particularly useful for the passage of cabling and the like.

In order to prevent deflection and to provide further structural support, upper stringer 14 can be supported every two feet by an intermediate column 20. Thus a four foot stringer 14 will have one intermediate column 20 at its midpoint, and a six foot stringer 14 may have two intermediate columns 20 that are located two feet from either frame end 12.

Intermediate columns 20 are connected between upper stringer 14 and lower stringer 16 such as by means of threaded fasteners using screw holes that are preferably preformed in the stringers as shown in FIG. 4. In addition to providing structural support, columns 20 also serve as points of connection for doors, finishing panels, mounts for fixed and sliding shelves and other fitments as will be described below. As seen most clearly in FIG. 4, columns 20 are mounted between the web portions of stringers 14/16 when intended primarily to provide structural support or as connecting points for shelf hardware, and between the rail portions of the stringers when they are to serve as supports for doors and panels mounted to the front of the base module as seen most clearly in FIG. 1.

Base module 10 thus comprises a frame in which the height and depth are predetermined, but for which the width can be selected to accommodate user requirements.

In the embodiment of FIG. 1, two base frames 11 are sistered together to create a full depth base module. This is easily accomplished using spline plates 32 to connect two frame ends 12 together, as best seen in FIGS. 1 to 6. Spline plates 32 are attached using screws or bolts which are threaded into spline plate screw holes 30. Spline plates 32 can be used on one or both sides of the frame ends.

Full depth modules can be used to accommodate equipment such as full size video monitors which are deeper than the depth of a single base module.

Figure 3:
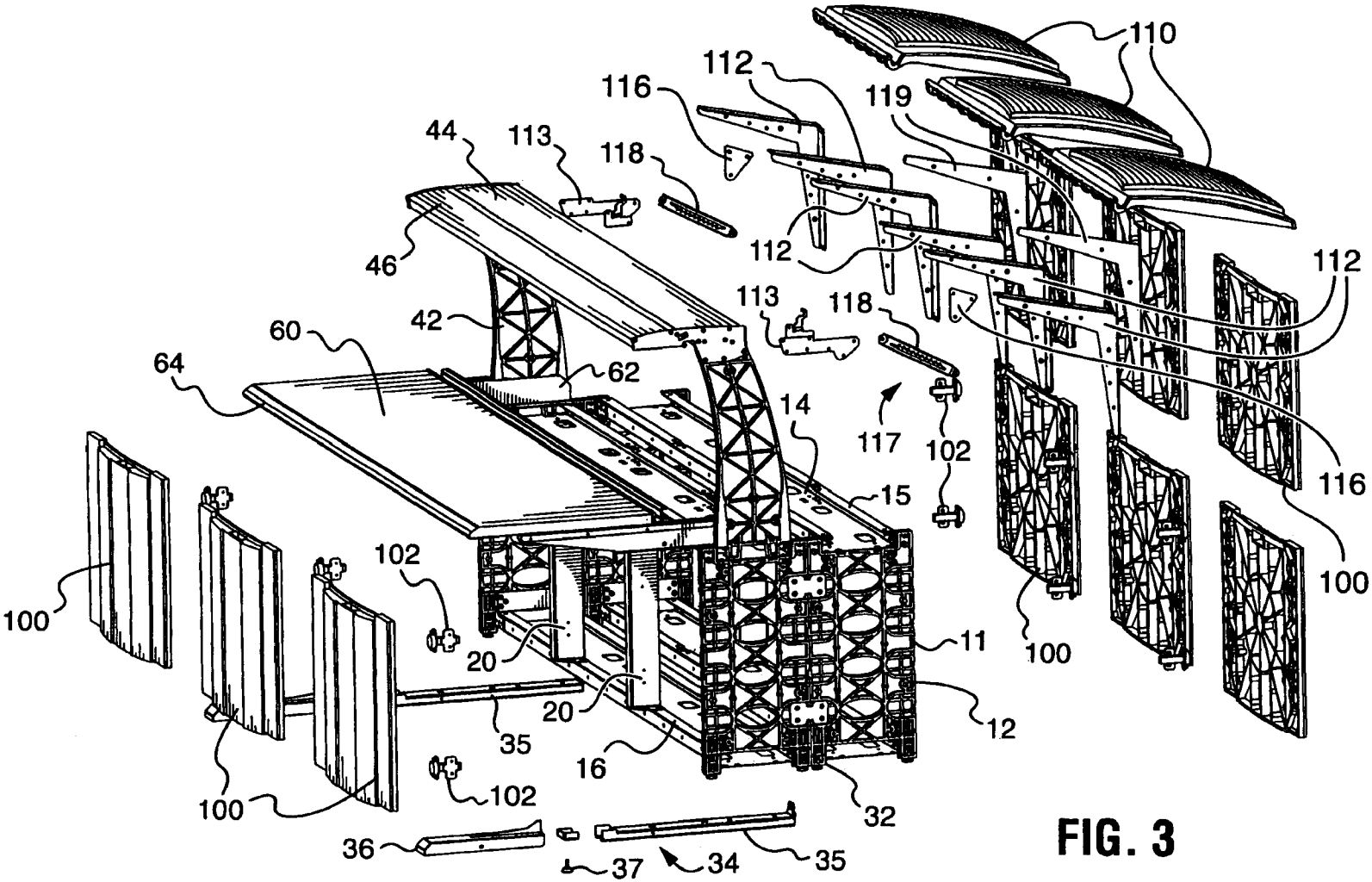
FIG. 3 is a partially exploded perspective view of the console.

Levelling screws 39 adjustably screwed into protrusions 24 to allow the base module 10 to rest squarely on irregular floors. Support feet 34 seen most clearly in FIGS. 1 and 3 are affixed adjacent the ends of lower stringer 16 to provide stability to the console and to prevent the console from tipping forwards. Each support foot 34 preferably includes a bracket 35 which connects to forwardmost lower stringer 16 such as by means of screws, a forwardly extending foot portion 36 extending from bracket 35, and a connecting screw/nut 37 which joins bracket 35 to foot portion 36.

In some instances, the upper surface of the base module might be finished very simply with a panel to be used as a work or support surface. In most instances however, the base module will support a turret 40 for video and CRT displays, communications and switch gear and other equipment. There follows therefore a description of turret 40.

Turret 40 is to be affixed above base module 10. One of the advantages of the present console structure is that base module 10 and turret 40 do not necessarily need to correspond in width with each other. Turret 40 can be wider or narrower than base module 10, or a turret can overlap several base modules 10, or multiple turrets can fit over a single base module 10. Further, space over a base module 10 that is unused by a turret 40 can be covered with a work surface.

The basic components of the turret are a pair of upper frame ends 42 and a beam 44 connected therebetween. Like lower frames 12, the upper frames are preferably injection moulded from structural foam and are formed with a number of reinforcing ribs to provide strength and rigidity.

The lower end of each upper frame 42 is formed with a pair of spaced apart protrusions 43 that fit between rails 15 of upper stringer 14, and can be affixed to upper stringer 14 using bolts or screws. The lower surfaces 44 of the upper frames extending laterally outwardly from the upper ends of protrusions 43 rest on the top surface of the rails, and can be connected to the rails with bolts or screws for further strength and stability. The stringer rails 15 are formed with regularly spaced detentes 9 and associated preformed screw holes for connection of the upper frame at selected locations. The spacing between detentes is typically 2 feet but this can be varied if required. Each detente is sufficiently wide and includes enough preformed screw holes to permit the installation of two side by side upper frames for turrets of extended length.

Each upper frame 42 can be moulded with a number of screw holes to facilitate connection to other components. These will include screw holes 50, seen most clearly in FIG. 6, used to connect work surface support arms 62 to the turret.

Between each pair of upper frame ends 42 is affixed beam 44. Beam 44 is preferably an aluminium extrusion, and like upper and lower stringers 14 and 16 it can be manufactured in a number of standard lengths of 2, 4 or 6 feet. The selection of beam length determines the width of each turret module, and this width can be independent from the width of the base module or modules 10 supporting the turret.

Beam 44 is connected to upper frame ends 42 using valance end caps 48 as best seen in FIG. 1.

Figure 11:
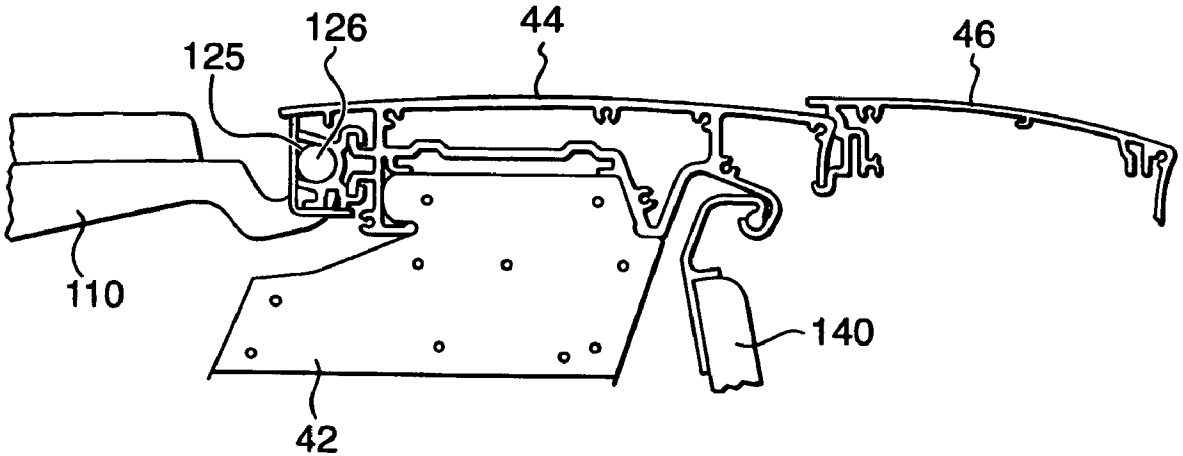
FIG. 11 is a side elevational cross-sectional view of a beam forming part of the turret structure of the present console.

Beam 44 is shown in cross-section in FIG. 11. The beam is used to support equipment front panels 140 that fit over monitor screens to trim the space between the screens and the console. The beam is adapted as shown in FIG. 11 to engage the correspondingly shaped upper end of each frame 42.

Beam 44 and end caps 48 are also used to support another aluminum extrusion 46 which houses a task light (not shown) to illuminate work surface 60.

The present console structure preferably also includes a work surface 60. Work surface 60 is a flat surface extending forwardly of base module 10 and is connected to upper frame ends 42 by means of work surface support arms 62 as described above. Work surface 60 can include a padded nosing 64 for a user's comfort.

Figure 5:
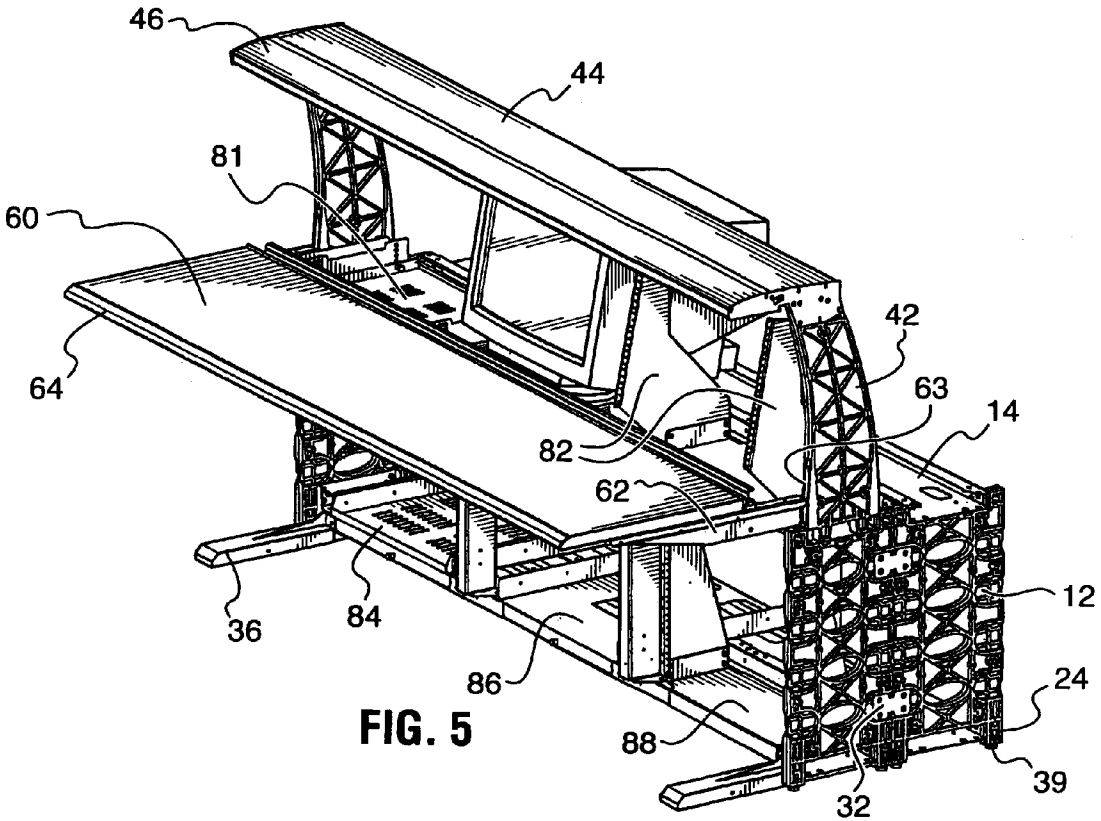
FIG. 5 is a front perspective view of the console including some internal fitments.

Once base module 10 and turret 40 are configured, various internal fitments can be added to the console depending on user and equipment requirements. Examples of fitments are illustrated in FIG. 5, which shows a monitor shelf 81, upper rack mounts 82, a sliding shelf 84, a fixed processor shelf 86 and a lower rack mount 88. One skilled in the art will appreciate that other internal fitments are possible.

The internal fitments attach to upper and lower stringers 14 and 16 in a like manner, at discreet intervals. This ability to add different internal fitments allows the present console structure to be easily adapted to user requirements and facilitates re-engineering and reconfiguration of the console structure if those requirements change over time.

Any combination of base modules 10, turrets 40, desk tops and corner units can be placed together depending on design requirements. The ends of all of the modules, including any corners, are consistent, allowing for reconfiguration. This flexibility using standard components provides cost savings in the design stage, as well as in manufacturing and storage.

Further reconfiguration, which is often necessary, is easier in the present system, since turret components can be changed without changing the lower base module 10. Also, a full depth base can be turned into a reduced depth base easily, and the reverse is also true. This has the advantage that when migrating or reconfiguring from a full to a reduced depth console, the omitted frame can be used as the base frame for a second reduced depth base module.

The present console is further provided with finishing panels that can be affixed to the external surface. These finishing panels can best be seen in FIGS. 2, 3 and 12 to 18.

The finishing panels comprise a series of standard sized panels, including skirt panels 100, ventilation grills 110, and side panels 120.

Skirt panels 100 are affixed to the front and rear surfaces of the present console structure. In a preferred embodiment, skirt panels 100 are 2 feet wide and can be affixed to any base module 10. When base module 10 is wider than two feet, the skirt panels are affixed between frame ends 12 and intermediate columns 20. Panels 100 can be injection moulded to include the internal ribbed structure shown in FIG. 14 to provide strength and rigidity and various pre-formed screw holes, slots and openings for fasteners and to attach hinges, clips, mounting hardware and so forth.

The height of skirt panels 100 is slightly less than the height of frame ends 12, allowing skirt panels 100 to be installed under work surface 60 at the front of the present console structure, and allowing two skirt panels 100 to be mounted in vertical alignment atop one another, thus covering the entire rear surface of a console having a turret structure. Further, to accommodate this panel stacking, the top of the lower skirt panel 100 can be adapted to secure against the bottom of the upper skirt panel 100 by including protrusions in the upper edge of the bottom panel that fit into recesses in the lower edge of the upper skirt panel.

Skirt panels 100 can function as doors if connected to base module 10 using hinges 102, as best seen in FIG. 3. Preferred hinges are the European style zero clearance hinges such as the BLUM 1090° model. The skirt panels are preformed with the circular recesses 104 required for this type of hinge, and the hinge stalks can be secured to end frames 12 or columns 20, as the case may be using screw holes preformed in these components.

The turret portion of the console is enclosed using a skirt panel 100 connected to a ventilation grill 110. There are two sizes of ventilation grill 110, the full depth version illustrated in FIGS. 3, 15 and 16, and the reduced depth version shown in FIGS. 17 and 18.

Figure 6:
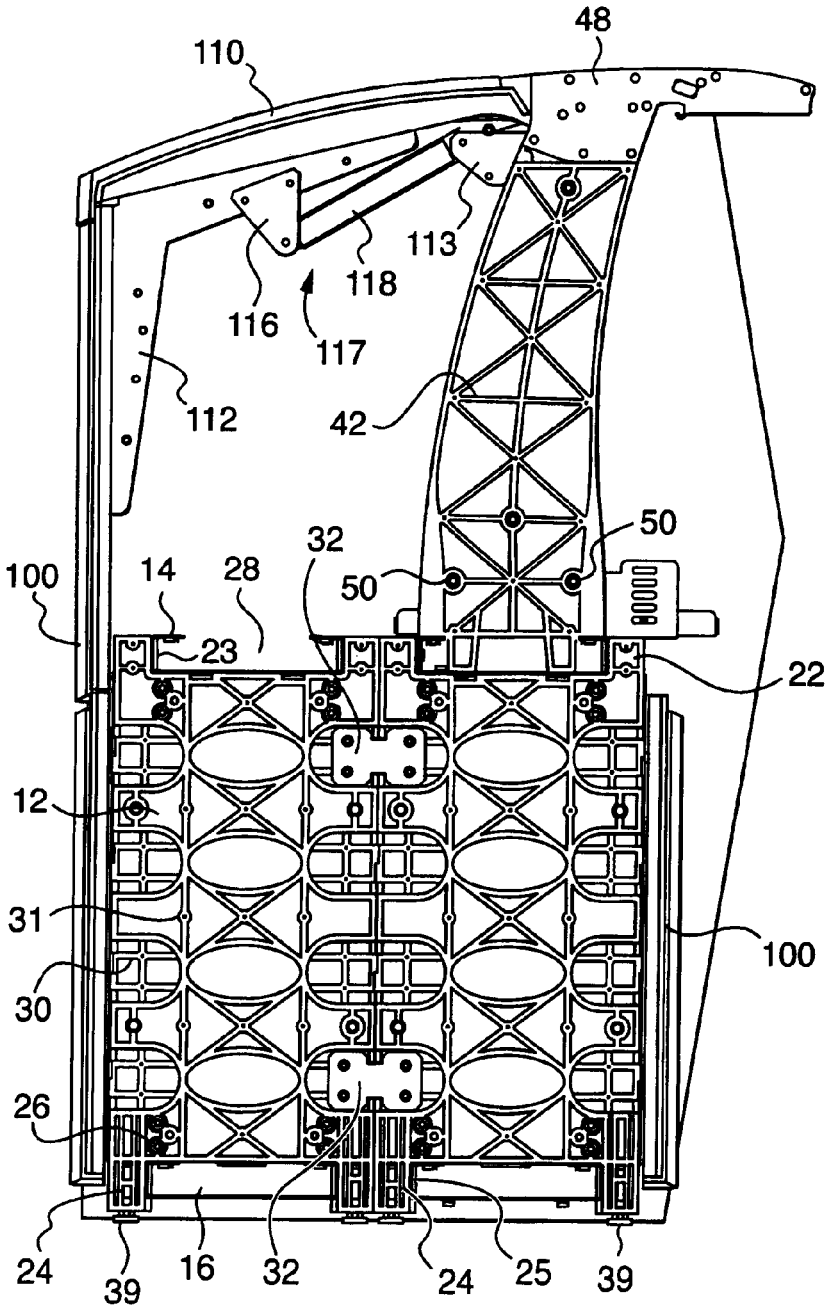
FIG. 6 is a side elevational partially schematical view of the console.

With reference to FIGS. 3 and 6, each grill 110 is respectively connected to an upper skirt panel 100 using a stiffening bracket 112. Stiffener 112 attaches to preformed screw holes 114 along the inside edges of grill 110 and to similar screw holes 121 in the inner surface of skirt panel 100, holding the two at a pre-defined angle to each other. A spacer 119 can be used to keep the correct spacing between the cladding but is not essential and this element can be deleted. The forward edge of grill 110 is formed into an elongated circular bead 126 that fits into a correspondingly shaped channel 125 in beam 44 to act as a hinge line so that each grill/skirt panel assembly can be pivoted between an open and closed position. To hold the assembly in an open position allowing access to the turret's interior, known mechanisms such as gas-filled struts can be used or the rachet mechanism 117 shown most clearly in FIG. 6. This is a commercially available system and need not therefore be described in great detail herein, but the system includes a first bracket 113 that connects adjacent to the top of upper frame 42, a second bracket 116 that connects to stiffener 112 and a rachet 118 that connects between the two brackets. The advantage of this system is that it allows the cladding to be opened a selected amount and then positively locked into that position for safety. Gas struts are however simpler and cheaper and will likely be preferred by many users.

Figure 12:
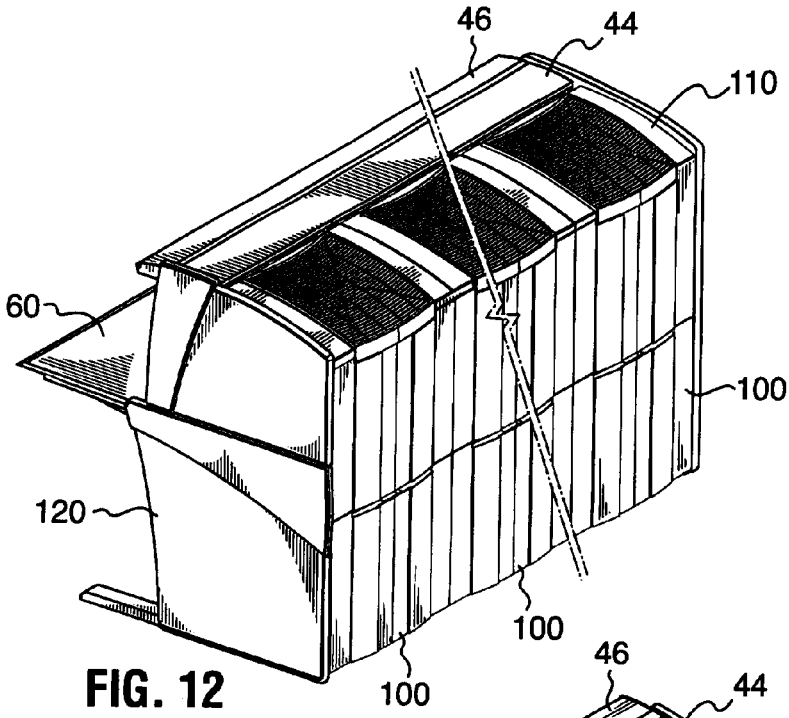
FIG. 12 is a rear perspective view of a full depth console including finishing panels thereon.
Figure 13:
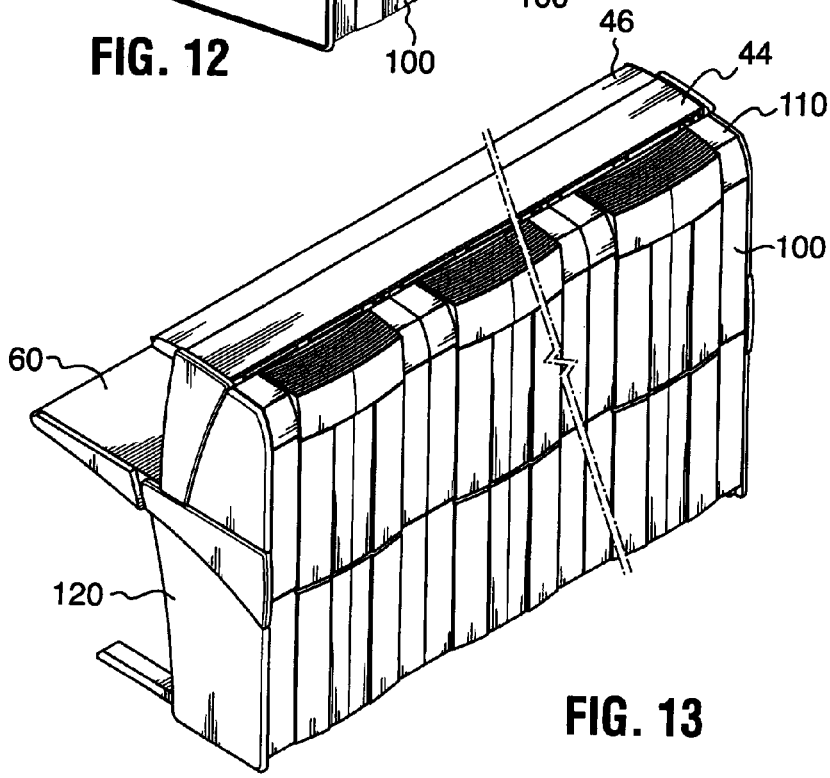
FIG. 13 is a rear perspective view of a reduced depth console including finishing panels thereon.
Figure 14:
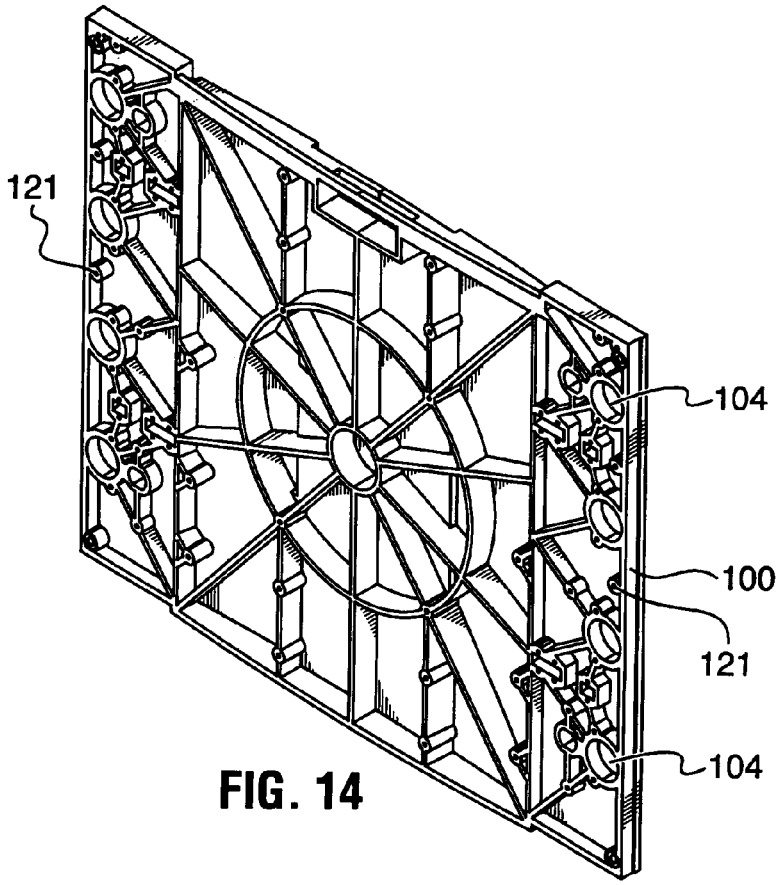
FIG. 14 is a rear perspective view of a skirt finishing panel.
Figure 15:
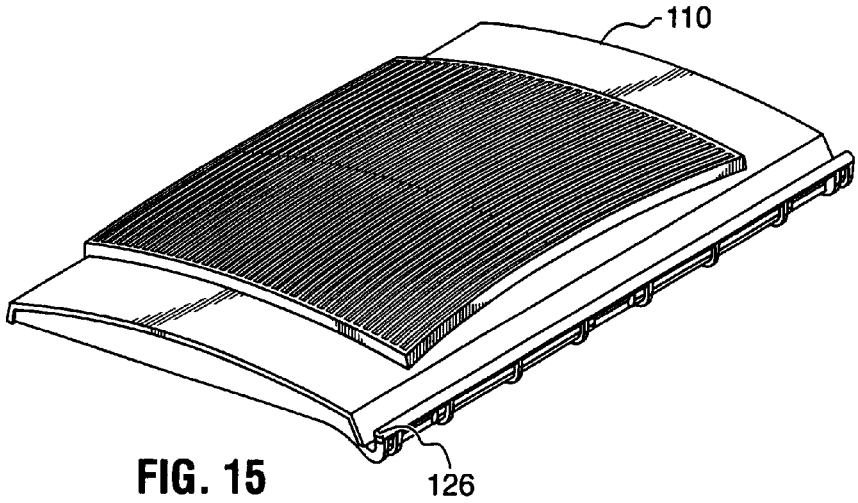
FIG. 15 is a front perspective view of a ventilation grill for the full depth console.
Figure 16:
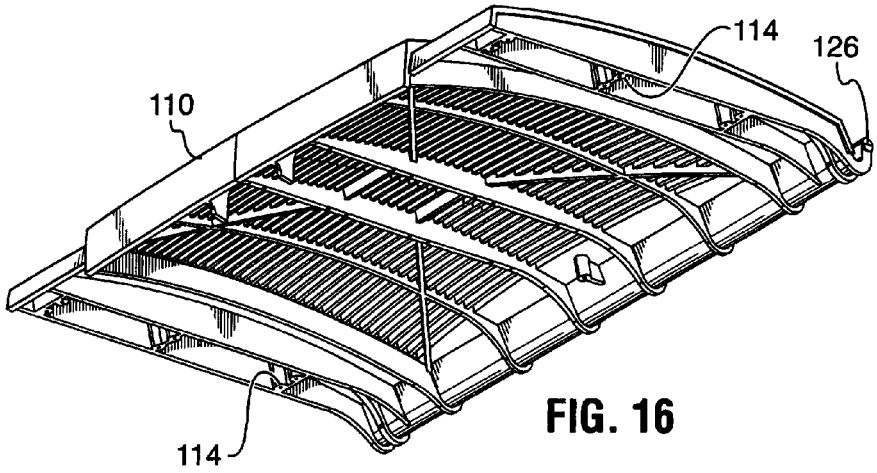
FIG. 16 is a bottom perspective view of the full depth ventilation grill.
Figure 17:
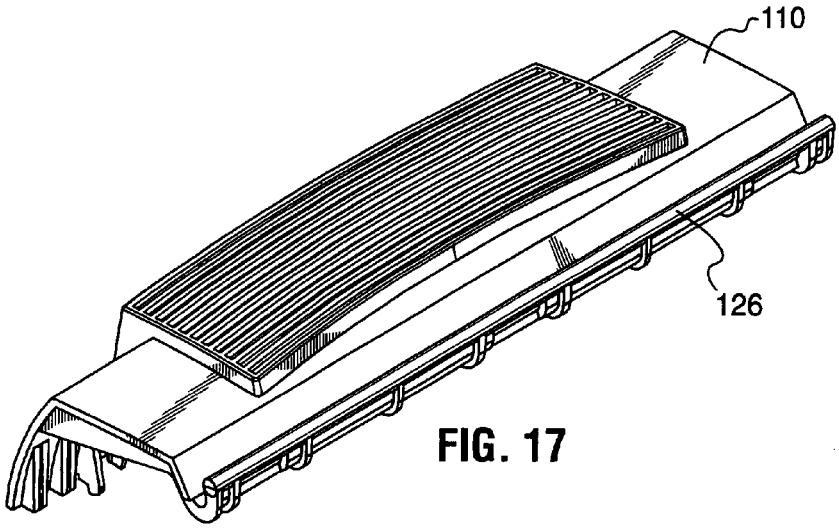
FIG. 17 is a front perspective view of a reduced depth ventilation grill for the present console.
Figure 18:
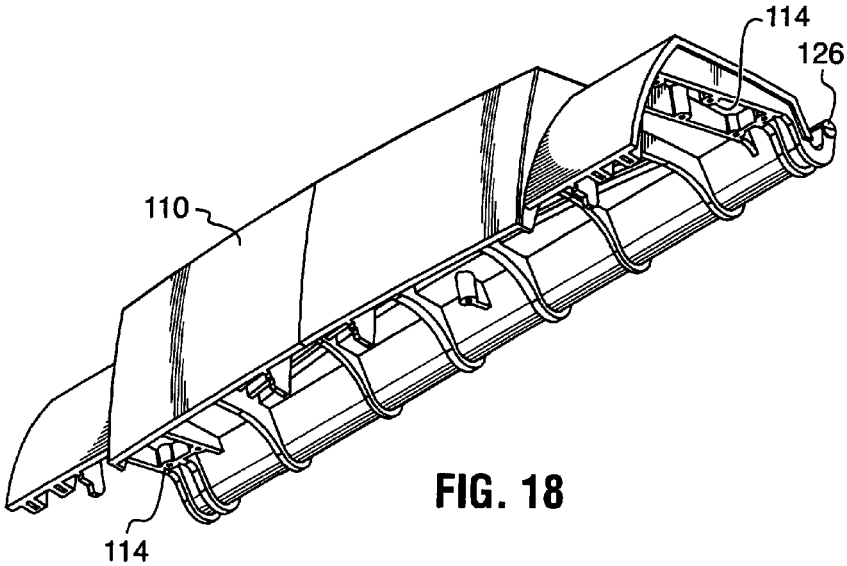
FIG. 18 is a bottom perspective view of the reduced depth ventilation grill.

Side panels 120 are used at the ends of the console structure, and are affixed to end frames 12 and upper end frames 42. Side panels 120 are illustrated in FIG. 12 for a full depth console and in FIG. 13 for a reduced depth console.

In an alternative embodiment where a base having a flat work surface is placed at the end of a console structure having both a base and a turret, side panel 120 will be split accordingly.

In operation, a console can be quickly and easily designed using the above-described components. The base modules 10 can be created for optimum layout and to best use the floor space available in accordance with user requirements and turrets can be mounted as needed anywhere along the length of the base modules. Further, depending on the type of equipment to be placed within the console, the designer can choose a reduced or a full depth structure. Hybrids are also possible, for example a full depth base module supporting two oppositely facing turrets.

Further, corners can also be added to the present console structure by using corner sections in a manner well known in the console art.

Although the present invention has been described in detail with regard to the preferred embodiment thereof, one skilled in the art will easily realize that other versions are possible, and that the invention is only intended to be limited in scope by the following claims.

What is claimed is:

1. A console structure for supporting equipment thereon, comprising:

a lower base structure comprising at least one base module, each base module comprising two spaced apart frame ends, an upper stringer connected to and disposed between said frame ends and a lower stringer connected to and disposed between said frame ends to be substantilly parallel to and below said upper stringer, said at least one base module being adapted for connection to another said base module for increasing the length of said console structure;

an upper turret structure supported on said base structure said turret structure comprising two spaced apart upper frame ends, each upper frame end having an upper and a lower end and a beam member connected to and disposed between said upper frame ends adjacent said upper ends thereof;

said turret structure being independently laterally positionable relative to said base structure wherein said lower end of each upper frame end is connectable to said upper stringer of said base module anywhere along the length of said upper stringer between said frame ends whereby said turret structure can be supported by a single said base module or by separate base modules connected end to end.

2. The console structure of claim 1, wherein said base modules can be connected side to side to increase the depth of said console structure.

3. The console structure of claim 2, wherein base modules connected side by side to one another can each independently support said turret structure thereon.

4. The console structure of claim 1, wherein said upper stringer includes one or more detentes formed therein adapted for connection to said lower end of each said upper frame end for positioning of each said upper frame end at predetermined point along said upper stringer corresponding to the location of said detentes.

5. The console structure of claim 4 wherein the lower end of each said upper frame end includes downwardly extending protrusions shaped to engage said detentes in said upper stringer for connection thereto.

6. The console structure of claim 5 wherein each frame end of said base module has an upper and a lower end, said upper end including an upwardly opening recess formed therein, and said lower end including a downwardly opening recess formed therein, said recesses being sized and shaped to respectively receive thereinto said upper and lower stringers.

7. The console structure of claim 6 wherein said upper and lower recesses include registration means therein for engaging and thereby positioning said stringers in said recesses.

8. The console structure of claim 7 wherein said registration means comprise flanges that fit into and engage correspondingly shaped slots in said upper and lower stringers.

9. The console structure of claim 8 wherein said stringers are preformed with holes for fasteners used to connected equipment supporting fitments and other structural components of said console structure to said stringers.

10. The console structure of claim 9 wherein said stringers are preformed with apertures therein for the passage of cabling through said stringers.

11. The console structure of claim 1, wherein said base modules can be connected at an angle to one another to define a bend in said console structure.

12. A method of positioning a turret structure relative to one or more base structure, said turret and base structre forming part of an equipment console used to support pieces of work station equipment, comprising the steps of:

forming the turret and base structures as discrete module, said base structure comprising ar least one base module, each base module comprising two spaced apart frame ends, an upper stringer connected to and disposed between said frame ends and a lower stringer connected to and disposed between said frame ends to be substantially parallel to below said upper stringer, said at least one base module being adapted for connection to another said base module for increasing the length of said console structure, said turret structure comprising two spaced apart upper frame ends, each upper frame end having an upper and a lower end and a beam member connected and disposed between said upper frame ends adjacent said upper ends thereof; and forming the turret structure to be connectable to said structure at any point along the length of one of said base structure or straddling base structure arranged in end to end alignment with one another, wherein said lower end of each upper frame end is connected to said upper stringer of said base module anywhere along the length of said upper stringer between said frame ends whereby said turret structure can be supported by a single said base module or separate base module connecred end to end.

13. The method of claim 12 wherein said upper stringer includes formed therein a plurality of spaced apart connecting points for said lower end of each said upper frame end, whereby connecting points can be chosen corresponding to the length and placement of said turret structure relative to said base structure or structures.

14. A method for the assembly of a framework for a console structure using discrete modules, comprising the steps of:

forming one or more base modules of a predetermined length, height and depth, each said base module comprising two spaced apart frame ends, an upper stringer connected to and disposed between said frame ends and a lower stringer connected to and disposed between said frame ends to be substantillay parallel to and below said upper stringer, said at least one base module being adapted for connection to another said base module for increasing one or both of the length and depth of said console structure;

forming one or more turret modules of a predetermined length, height and depth, each said one or more turret modules comprising two spaced apart upper frame ends, each upper frame end having an upper and a lower end and a beam member connected to and disposed between said upper frame ends adjacent said upper ends thereof;

assembling said base modules into a console base of predetermined length, height and depth; and connecting said one or more turret anywhere along the length of said base module, whereby said lower end of each upper frmae end is connectable to said upper stringer of said module anywhere along the length of said upper stringer between said frame ends whereby said one or more turret modules can be supported by a single said base module or by separate modules connected end to end or side by side.

* * * * *